US006149065A

United States Patent [19]

White et al.

[11] Patent Number: 6,149,065

[45] Date of Patent: Nov. 21, 2000

[54] MODULATING THERMOSTAT FOR GAS OVEN BURNER

[75] Inventors: David B. White; Charles S. White, both of Princeton, Ill.

[73] Assignee: Harper-Wyman Company, Aurora, Ill.

[21] Appl. No.: 09/182,294

[22] Filed: Oct. 28, 1998

[51] Int. Cl.[7] ..... F23N 1/00

[52] U.S. Cl. ..... 236/15 A; 236/680

[58] Field of Search ..... 236/15 A, 68 B; 126/39 G

[56] References Cited

U.S. PATENT DOCUMENTS

| | | | |
|---|---|---|---|
| 2,245,060 | 6/1941 | Waddell | 236/15 A |
| 3,542,290 | 11/1970 | Fleer | 236/15 A |
| 4,765,536 | 8/1988 | Bergquist | 236/15 A |

*Primary Examiner*—Ira S. Lazarus
*Assistant Examiner*—Sara Clarke
*Attorney, Agent, or Firm*—Mason, Kolehmainen, Rathburn & Wyss; Phillip M. Kolehmainen

[57] ABSTRACT

A modulating thermostat for a gas oven includes a body with supply, main and pilot passages. Feeder passages from the supply passage to the main and pilot passages provide a pilot gas flow for a pilot burner and a minimum combustion bypass flow to a main oven burner. The feeder passages are drilled along paths leading from mouths of the main and pilot passages and adjustment sleeves installed at the mouths adjust the gas flows for particular oven and fuel requirements. A temperature modulating valve assembly in the supply passage includes a valve member cooperating with a valve seat in the body to modulate gas flow and maintain an oven temperature set by rotation of a valve stem at the front of the thermostat. The thermostat is calibrated by rotating a sleeve accessible through the hollow stem at the front of the thermostat.

10 Claims, 4 Drawing Sheets

MODULATING THERMOSTAT FOR GAS OVEN BURNER

FIELD OF THE INVENTION

The present invention relates to an improved modulating thermostat for gas ovens, and more particularly to a modulating thermostat that is simple and inexpensive to manufacture.

DESCRIPTION OF THE PRIOR ART

A typical gas oven includes a main gas burner and a temperature sensing device such as a liquid filled bulb communicating by a capillary tube with an expansible diaphragm in an oven thermostat. In the past most gas oven thermostats have maintained oven temperature by cycling between full on and off. In such a system, a valve in the thermostat is opened by the temperature sensor to supply gas to the main burner to heat the oven when the sensed temperature is below the set temperature. Conversely the main burner valve is closed by the temperature sensor to interrupt the supply gas of gas to the main burner when the set temperature is reached.

In order to improve oven performance, it has been proposed to use a modulating thermostat in place of a cycling on-off thermostat. However, known modulating thermostats are complex and expensive to manufacture and assemble. Known modulating thermostats include machined metal bodies having numerous internal passages requiring extensive fabricating operations. Typically gas flow passages are drilled through the metal body and unused end portions of the drilled passages must be sealed, often by force fitting a sealing ball into the end of the passage. This requires additional parts and assembly steps, and results in potential leakage paths.

Another disadvantage of many known thermostats arises from the need to match the thermostat to a particular oven environment and fuel. Passages supplying pilot burners or bypass flows to main burners must be adjusted for proper flow rates. In a typical thermostat, such adjustments are done with needle valves. Such valves are expensive, increasing the cost of the thermostat.

It is also necessary to provide for calibration of the valve so that the oven temperature maintained by the thermostat matches the temperature set by the user. Typically the user sets the temperature by rotating a knob carried on a valve stem projecting from the front of the thermostat body. The stem rotates a valve plug that controls the admission of gas to the, thermostat and that operates an adjustable coupling or linkage that controls the position of a temperature responsive valve member relative to a valve seat in the thermostat body. To calibrate the thermostat, typically an adjustment is made at the back of the thermostat to adjust the relationship between the expansible diaphragm or valve member and the valve seat. This type of calibration adjustment is awkward, cannot easily be performed after installation of the thremostat, and often requires complex and expensive parts and assembly operations.

SUMMARY OF THE INVENTION

A principal object of the present invention is to provide an improved modulating thermostat that is simple and inexpensive to manufacture. Other objects are to provide a modulating thermostat avoiding the need for balls or other seals for passages in the thermostat body; to provide a modulating thermostat having a convenient and simple calibration arrangement; to provide a modulating thermostat having an improved arrangement for adjusting small volume pilot gas flow and/or main burner bypass flow; and to provide a modulating thermostat overcoming disadvantages of modulating thermostats used in the past.

In brief, in accordance with the invention there is provided a modulating thermostat for supplying gas from a gas supply to an oven having a main burner, a pilot burner and a temperature sensor. The thermostat has a body with a front wall and a rear wall. A supply passage extends between the front and rear walls and includes an inlet section adapted to be connected to the gas supply and an outlet section. A temperature responsive valve separates the inlet and outlet sections of the supply passage, the temperature responsive valve including a valve seat and a modulating valve member adapted to be connected to the oven temperature sensor. Main and pilot passages extend between the front and rear walls and are spaced from one another and from the supply passage. Each of the main and pilot passages has a mouth at the front wall of the body. A main burner outlet port in the rear wall communicating with the main passage is adapted to be connected to the oven main burner. A pilot burner outlet port in the rear wall communicating with the pilot passage is adapted to be connected to the oven pilot burner. An outlet passage extends from the outlet section of the supply passage to the main passage. A bypass feeder passage extends from the inlet section of the supply passage to the main passage. A pilot feeder passage extends from the inlet section of the supply passage to the pilot passage. The bypass and pilot feeder passages are formed by drilling through the body along paths that enter the body at the mouths of the bypass and pilot flow passages and extend to the inlet section of the supply passage.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENTS

Figure 1:
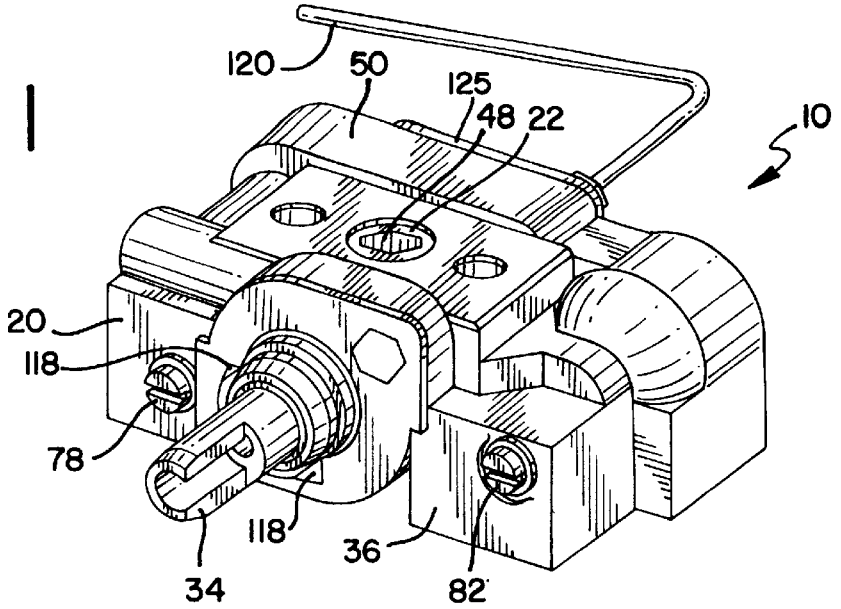
FIG. 1 is an front and bottom isometric view of a modulating thermostat embodying the present invention.
Figure 2:
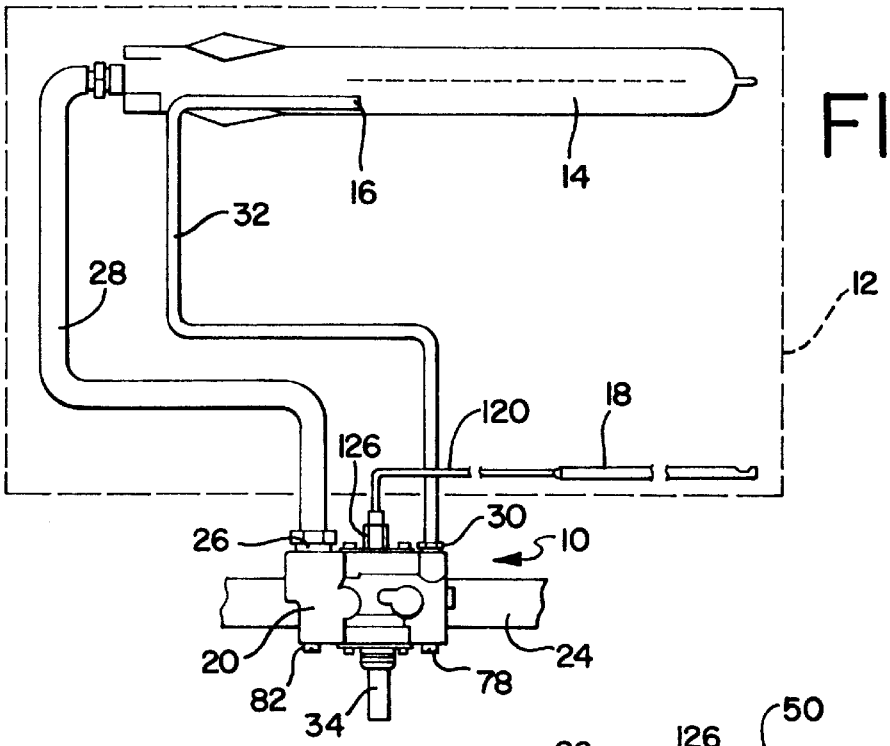
FIG. 2 is a schematic diagram of an oven system including the modulating thermostat of FIG. 1.
Figure 3:
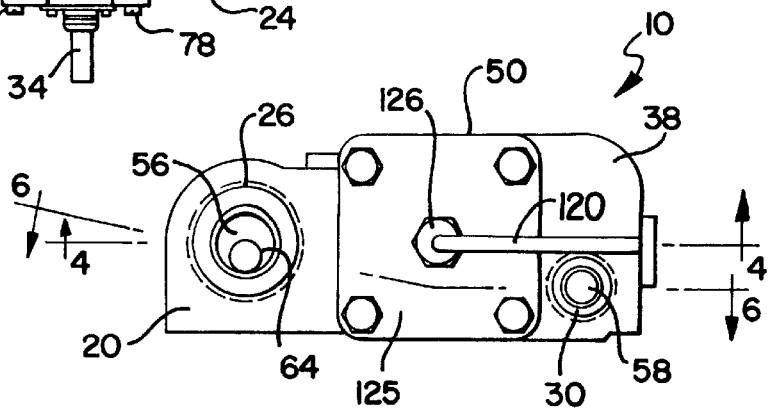
FIG. 3 is a rear elevational view of the modulating thermostat.

Having reference now to the drawings and initially to FIGS. 1–3 there is illustrated a modulating thermostat generally designated as 10 and constructed in accordance with the principles of the present invention. As seen in FIG. 2, the thermostat 10 is used with a gas oven 12, schematically shown in broken lines, having a main oven burner 14, a pilot burner 16 and a temperature sensing device 18. To heat the oven, the user operates the thermostat 10 to an on position to admit gas to both the main and pilot burners 14 and 16. The user ignites the gas flowing from the main burner 14 and the gas flowing from the pilot burner 16 is ignited by flame at the main burner 14. Thereafter the pilot burner 16 is able to reignite gas flowing from the main burner 14 if the flame is inadvertently extinguished by oven door slam or the like. The thermostat 10 functions to modulate gas flow to the main burner 14 in order to maintain a set oven temperature.

In general the thermostat 10 includes a body 20 having an inlet port 22 for receiving gaseous fuel from a gas supply such as a gas manifold 24 (FIG. 2), a main outlet port 26 for supplying gas through a conduit 28 to the main burner 14 and a pilot outlet port 30 for supplying gas through a conduit 32 to the pilot burner 16. A valve stem 34 carries a knob (not shown) with which the user rotates the stem 34 to operate the thermostat 10 to an off position in which no gas flows to the burners 14 and 16 or to one of a range of on positions in which an adjusted, constant flow of gas is supplied to the pilot burner 16, an adjusted, constant bypass flow of gas is supplied to the main burner 14 and the bypass flow is augmented by a modulated flow of gas to the main burner 14 for maintaining a set oven temperature corresponding to the rotational position of the valve stem 34.

Figure 4:
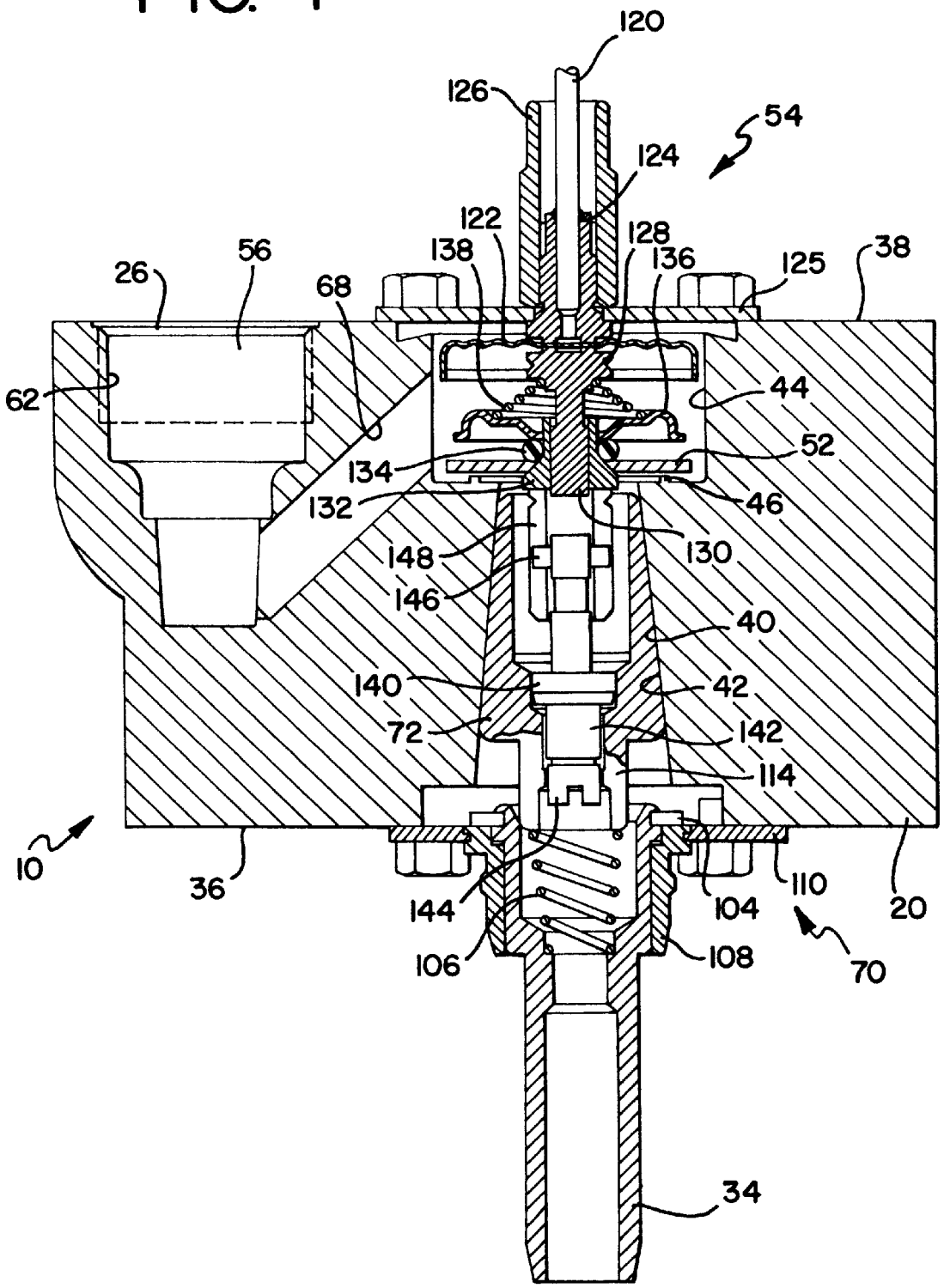
FIG. 4 is an enlarged cross sectional view of the modulating thermostat taken along the line 4—4 of FIG. 3.
Figure 6:
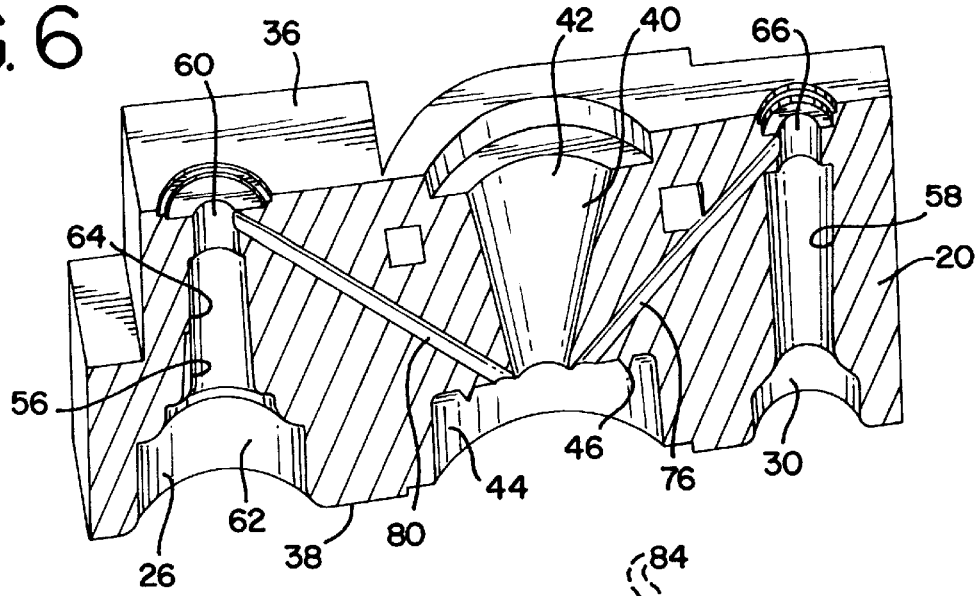
FIG. 6 is an isometric view of a cross section of the body of the modulating thermostat taken along the compound line 6—6 of FIG. 3.

The body 20 is preferably a machined aluminum casting and includes front and rear walls 36 and 38. As seen in FIGS. 4 and 6, a central supply passage 40 extends between the front and rear walls 36 and 38 along a major axis of the thermostat 10. A generally conical inlet section 42 extends from the front wall 36 and an outlet section 44 extends from the rear wall 38. The inlet and outlet sections 42 and 44 are separated by a valve seat 46. An inlet passage 48 (FIG. 1) extending upward from a bottom wall 50 of the body 20 supplies gas from the inlet port 22 to the conical inlet section 42. A valve member 52 of a modulating valve assembly 54 cooperates with the valve seat 46 to modulate flow from the inlet section 42 to the outlet section 44.

A main passage 56 and a pilot passage 58 extend between the front and rear walls 36 and 38, spaced from and at opposite sides of the supply passage 48. The main passage 56 communicates with the main outlet port 26 at the rear wall 38, and includes a main mouth portion 60 at the front wall 36. The main passage 56 includes an enlarged rear portion 62 (FIG. 4) extending forward from the main outlet port 26 and a smaller offset portion 64 (FIGS. 3 and 6) extending from the mouth portion 60 to the enlarged portion 62. The pilot passage 58 communicates with the pilot outlet port 30 at the rear wall 38, and includes a pilot mouth portion 66 at the front wall 36. An outlet passage 68 (FIG. 4) extends from the outlet section 44 of the supply passage 40 to the main passage 56.

Figure 5:
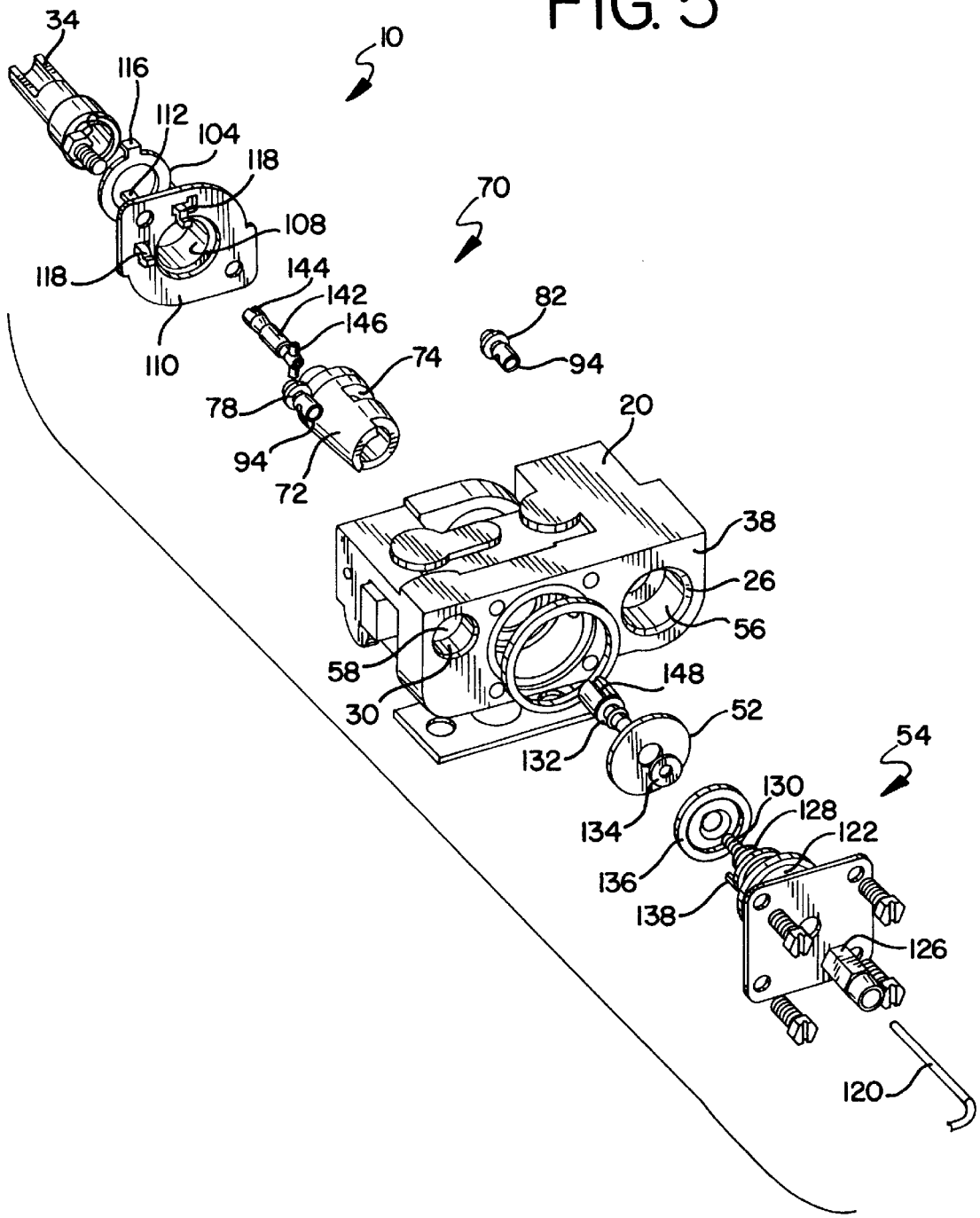
FIG. 5 is an exploded isometric view of the modulating thermostat.

A manually operated valve assembly 70 includes a conical valve plug 72 seated in the conical inlet section 42 of the supply passage 40. When the valve stem 34 is in the off position, the valve plug 72 blocks the inlet passage 48 and no gas is permitted to flow into the inlet section 42. When the valve stem is rotated to any position in the range of on positions, an aperture 74 in the valve plug 72 (FIG. 5) registers with the inlet passage and gas flows into the inlet section 42.

Gas is supplied continuously to the pilot burner 16 when the thermostat 10 is operated to any on position. A pilot feeder passage 76 extends from the inset section 42 to the pilot passage 58 so that when gas enters the inlet section 42, gas flows through the pilot feeder passage 76 and the pilot passage 58 to the pilot outlet port 30. A pilot flow adjustment sleeve assembly 78 is used to adjust the pilot flow to meet burner and fuel requirements. A bypass flow of gas is also supplied continuously to the main burner 14 when the thermostat 10 is operated to any on position. A bypass feeder passage 80 extends from the inset section 42 to the main passage 56 so that when gas enters the inlet section 42, gas flows through the bypass feeder passage 80 and the main passage 56 to the main outlet port 26. A bypass flow adjustment sleeve assembly 82 is used to adjust the bypass flow to meet burner and fuel requirements and assure that a minimum flow needed to maintain stable combustion is always present at the main burner 14 when the thermostat 10 is in any on position.

Figure 7:
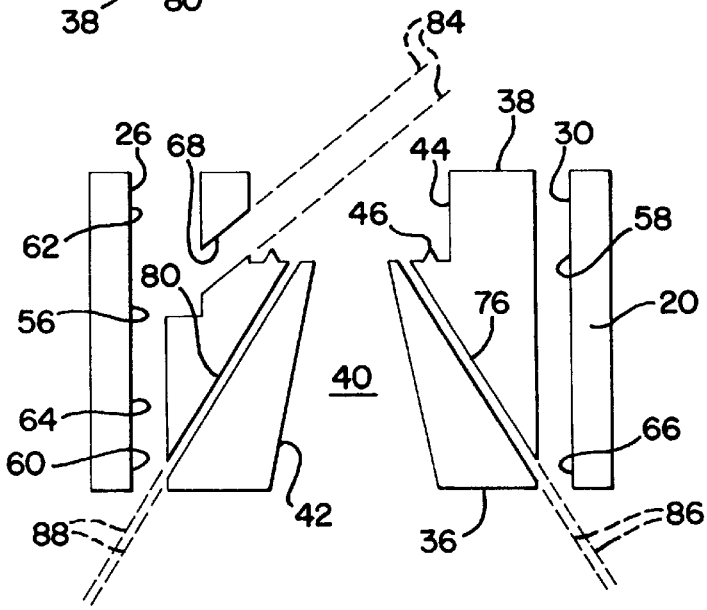
FIG. 7 is a diagram illustrating steps in the method for machining the body of the modulating thermostat.

The body 20 of the thermostat 10 is formed by casting of the aluminum body 20 and subsequent machining. The inlet and outlet passages 48 and 68 as well as the pilot and bypass feeder passages 76 and 80 are preferably drilled into the body 20. FIG. 7 provides a diagrammatic illustration of how the outlet passage 68 and the feeder passages 76 and 80 are formed. This illustration is illustrative and not physically accurate in that the passages 68, 76 and 80 do not lie in a common plane within the body 20. The actual position and orientation of the feeder passages 56 and 58 are in FIG. 6. The outlet passage 68 is drilled along a path indicated by the broken lines 84 in FIG. 7, and the inlet passage 48 (seen only in FIG. 1) can be drilled along a path extending upwardly from the bottom side wall 50.

The pilot feeder passage 76 is drilled along a path indicated by the broken lines 86 in FIG. 7. This path enters the body 20 at the pilot passage mouth portion 66 and extends at an angle to the inlet section 42 where it emerges inside the valve seat 46. Similarly the bypass feeder passage is drilled along a path indicated by the broken lines 88 and enters the body 20 at the main passage mouth portion 60 and extends at an angle to the inlet section 42, where it emerges within the valve seat 46. An advantage of this drilling method is that the locations where the feeder passages 76 and 80 intersect the pilot and main passages 58 and 56 at the mouths 66 and 60 is accurately determined. This is important for proper registration of the feeder passages 56 and 58 with the adjustment sleeve assemblies 82 and 78. Another advantage of this method of drilling the passages including the feeder passages 56 and 58 is that there are no unused passage segments extending to the exterior of the body 20 that require sealing by additional elements such as press fit sealing balls.

Figure 8:
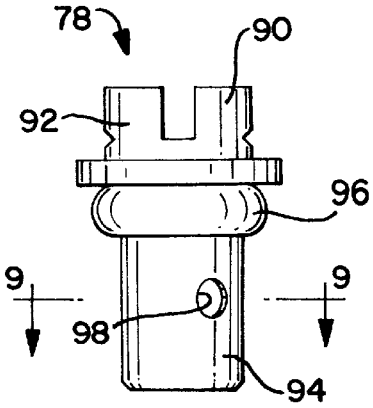
FIG. 8 is an enlarged side view of an adjustment sleeve assembly of the modulating thermostat.

The adjustment sleeve assemblies 78 and 82 may be identical, and the assembly 78 is seen in FIG. 8. A sleeve member 90 includes a slotted and flanged head 92 and a projecting tubular portion 94. An O-ring 96 is placed beneath the head 92. A flow adjustment opening 98 is formed in the tubular portion 94. The openings 98 of the adjustment sleeve assemblies 78 and 82 are axially located so that when the sleeve assemblies are installed in the mouth portions 60 and 66, the openings can be aligned with the feeder passages 76 and 78.

Figure 9:
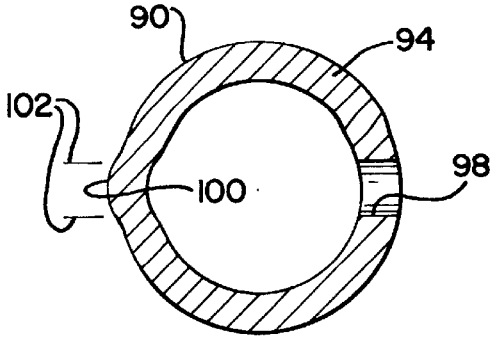
FIG. 9 is a further enlarged cross sectional view of the adjustment sleeve taken along the line 9—9 of FIG. 8 illustrating deformation of the sleeve during assembly of the modulating thermostat.

The sleeve members 90 are preferably formed of brass, a metal that is substantially softer than the aluminum of which the body 20 is made. Each sleeve assembly 78 and 82 is initially inserted into the corresponding mouth portion 60 or 66 with the opening 98 facing away from, or generally diametrically opposed to, the corresponding feeder passage 76 or 80. Then, with the head 92 supported against axial movement, a tool is inserted into the opposite end of the corresponding main or pilot passage 56 or 58. The tool is used to axially compress the tubular portion 94 in order to deform the tubular portion 94 and create a tight interference fit between the tubular portion 94 and the surrounding passage wall. The portion of the wall of the tubular portion 94 that overlies the feeder passage 76 or 80 during this deformation is slightly bulged outward into the feeder passage by the resulting axial compressive deformation. The resulting bulge 100 is seen in FIG. 9 opposite the opening 98 in the region indicated by the reference lines 102.

To adjust the flow from feeder passage 76 or 80 into the corresponding main or pilot passage 56 or 58, a bladed tool is used to rotate the sleeve member 90 to bring the opening 98 into a desired amount of overlap with the feeder passage 76 or 80. The bulge 100 tends to resiliently bias the sleeve member 90 to the side within the corresponding passage mouth and urges the tubular portion 94 toward the feeder passage to ensure a tight seal of the tubular portion 94 against the wall of the passage 56 or 58 to prevent leakage around the feeder passage opening.

As best seen in FIG. 4, the stem 34 is a hollow tubular body with its inner end swaged to a washer 104. A spring 106 biases the washer 104 forward against a bushing 108 attached to a front plate 110. The washer 104 has a radially inwardly extending tang 112 (FIG. 5) that drivingly engages a drive slot 114 at the forward end of the valve plug 72 (FIG. 4) so that rotation of the stem 34 results in rotation of the valve plug 72. An outwardly extending tang 116 (FIG. 5) of the washer 104 cooperates with limit abutments 118 on the front plate 110 to limit rotation of the stem 34 to about 270 degrees. In one limit position, the valve plug is in the off position, and blocks the inlet passage 48 to prevent the flow of gas into the inlet section 42 of the supply passage 40. The stem 34 can be rotated from the off position to any of a range of on positions in which the aperture 74 admits gas to the supply passage 42 and, by way of the feeder passages 76 and 79, to the pilot and main outlet ports 30 and 26. The range of on positions corresponds to a range of oven temperatures to be maintained by operation of the modulating valve assembly 54.

The temperature sensing device 18 is preferably a fluid filled bulb communicating through a capillary tube 120 with a diaphragm assembly 122 that expands as oven temperature increases. The capillary tube 120 terminates in a stud 124 attached to a back plate 125 by a nut 126. The interior of the stud 124 communicates with the interior of the diaphragm assembly 122, and a nib 128 having a threaded shank 130 is attached to the front of the diaphragm assembly 122. A spindle 132 is threaded onto the shank 130 and the valve member 52 is captured against the spindle 132 by an 0-ring 134, a cup member 136 and a spring 138. As the sensed temperature within the oven 12 increases, the expansion of the diaphragm assembly 122 moves the nib 128, spindle 132 and the valve member 52 forward toward the valve seat 46, decreasing gas flow through the modulating valve assembly from the inlet section 42 to the outlet section 44 of the supply passage 40.

Rotation of the stem 34 sets the thermostat 10 to heat the oven 12 to a selected temperature. Engagement of the washer tang 112 with the drive slot 114 permits the stem 34 to rotate the valve plug 72. A bushing 140 fixed to the valve plug 72 rotationally supports a sleeve 142 having a slotted head 144 at its forward end. A drive pin 146 is transversely supported at the rearward end of the sleeve 142. The drive pin 146 engages an elongated axial drive slot 148 in the forward end of the spindle 132. Rotation of the stem 34 and valve plug 72 causes the drive pin 144 to rotate the spindle 132 and the spindle is threaded forwardly or rearwardly along the shank 130 to decrease or increase the axial spacing between the valve member 52 and the diaphragm assembly 122. This varies the oven temperature corresponding to a given spacing between the valve member 52 and valve seat 46, thus setting a predetermined temperature to be maintained by the thermostat 10.

The thermostat 10 is calibrated in order to correct for manufacturing tolerances and other variables and to assure that the relation between stem position and set oven temperatures is correct. The thermostat 10 is calibrated by inserting a slotted tool into the hollow stem 34 and engaging the slotted head 144. The sleeve 142 is rotated while the stem 34 and valve plug 72 are stationary. This adjusts the axial position of the spindle 132 along the shank 130 so that in any given on position of the shank 34 and valve plug 72 the set oven temperature corresponds to the temperature desired by the user and indicated for example by indicia on a knob carried by the stem 34. Calibration is effected using the same threaded coupling that is used to set the operating temperature, resulting in a simple and inexpensive arrangement. In addition because the sleeve 142 is accessed from the front of the thermostat 10, the thermostat 10 can be calibrated after installation if needed because access to the back of the thermostat 10 is not required.

While the present invention has been described with reference to the details of the embodiment of the invention shown in the drawing, these details are not intended to limit the scope of the invention as claimed in the appended claims.

What is claimed is:

1. A modulating thermostat for supplying gas from a gas supply to an oven having a main burner, a pilot burner and a temperature sensor, said thermostat comprising:

a body having a front wall and a rear wall;

a supply passage extending between said front and rear walls and including an inlet section adapted to be connected to the gas supply and an outlet section;

a temperature responsive valve separating said inlet and outlet sections of said supply passage, said temperature responsive valve including a valve seat and a modulating valve member adapted to be connected to the oven temperature sensor;

main and pilot passages extending between said front and rear walls spaced from one another and from said supply passage and each having a mouth at said front wall;

a main burner outlet port in said rear wall adapted to be connected to the oven main burner and communicating with said main passage;

a pilot burner outlet port in said rear wall adapted to be connected to the oven pilot burner and communicating with said pilot passage;

an outlet passage extending from said outlet section of said supply passage to said main passage;

a bypass feeder passage extending from said inlet section of said supply passage to said main passage; and a pilot feeder passage extending from said inlet section of said supply passage to said pilot passage;

said modulating thermostat being characterized by:

said main and pilot passages each extending along a single straight line from said front to said rear wall;

said bypass feeder passage extending in a single straight line beginning at said mouth of said main passage and extending to said inlet section of said supply passage; and said pilot feeder passage extending in a single straight line beginning at said mouth of said pilot passage and extending to said inlet section of said supply passage.

2. A modulating thermostat as claimed in claim 1 further comprising bypass and pilot adjustment sleeves received in said mouths of said main and pilot passages for adjusting the flows from said bypass and pilot feeder passages into said main and pilot passages.

3. A modulating thermostat as claimed in claim 1, said body having a transverse wall extending between said front and rear walls and an inlet passage extending between said transverse wall and said inlet section of said supply passage.

4. A modulating thermostat as claimed in claim 3 further comprising a manually operated valve disposed in said inlet section for alternatively permitting and preventing flow from said inlet passage to said inlet section of said supply passage.

5. A modulating thermostat as claimed in claim 4, said manually operated valve including a valve plug in said inlet section and a stem coupled to said valve plug and projecting from said front wall.

6. A modulating thermostat as claimed in claim 5, said temperature responsive valve including a threaded adjustable coupling connected to said valve member and adapted to be connected to the temperature sensor for movement of said valve member relative to said valve seat in response to oven temperature changes; and a drive member carried by said valve plug and connected to said adjustable coupling for setting the oven temperature in response to rotation of said valve plug.

7. A modulating thermostat as claimed in claim 6, further comprising a calibration member interposed between said valve plug and said drive member for altering the position of said valve plug relative to the position of said drive member for calibrating the oven temperature setting.

8. A modulating thermostat as claimed in claim 7, said stem being hollow, and said calibration member being accessible through said hollow stem.

9. A modulating thermostat for supplying gas from a gas supply to an oven having a main burner, a pilot burner and a temperature sensor, said thermostat comprising:

a body having a front wall and a rear wall;

a supply passage extending between said front and rear walls and including an inlet section adapted to be connected to the gas supply and an outlet section;

a temperature responsive valve separating said inlet and outlet sections of said supply passage, said temperature responsive valve including a valve seat and a modulating valve member adapted to be connected to the oven temperature sensor;

main and pilot passages extending between said front and rear walls spaced from one another and from said supply passage and each having a mouth at said front wall;

a main burner outlet port in said rear wall adapted to be connected to the oven main burner and communicating with said main passage;

a pilot burner outlet port in said rear wall adapted to be connected to the oven pilot burner and communicating with said pilot passage;

an outlet passage extending from said outlet section of said supply passage to said main passage, a bypass feeder passage extending from said inlet section of said supply passage to said main passage; and a pilot feeder passage extending from said inlet section of said supply passage to said pilot passage;

said modulating thermostat being characterized by:

bypass and pilot adjustment sleeves received in said mouths of said main and pilot passages for adjusting the flows from said bypass and pilot feeder passages into said main and pilot passages; and each said adjustment sleeve including a tubular portion received in the corresponding said mouth and an opening in said tubular portion aligned with said corresponding feeder passage by rotation of said adjustment sleeve.

10. A modulating thermostat as claimed in claim 9, said body being formed of aluminum and said tubular portions being formed of brass, each said tubular portion being secured in said corresponding mouth by axial compressive deformation of said tubular portion while said opening is spaced from said corresponding feeder passage.

* * * * *